United States Patent [19]

Williams

[11] Patent Number: 5,042,874

[45] Date of Patent: Aug. 27, 1991

[54] FOLDING BEACH LOUNGE

[76] Inventor: Daniel E. Williams, 2424 S. Dixie Hwy., Ste. 200, Miami, Fla. 33133

[21] Appl. No.: 379,341

[22] Filed: Jul. 13, 1989

[51] Int. Cl.[5] ..... A47C 4/00

[52] U.S. Cl. ..... 297/17; 297/377

[58] Field of Search ..... 297/17, 377, 184, 185, 297/218; 5/417, 418, 419, 420, 432, 433

[56] References Cited

U.S. PATENT DOCUMENTS

| | | | |
|---|---|---|---|
| 33,398 | 10/1861 | Miller | 297/17 X |
| 2,290,786 | 7/1942 | Varady | 5/418 |
| 2,803,845 | 8/1957 | Bradford | 5/417 |
| 2,834,032 | 5/1958 | Scott | 5/433 |
| 2,946,067 | 7/1960 | Wolshin | 5/418 |
| 3,006,688 | 10/1961 | Ouellette | 5/432 X |
| 3,144,657 | 8/1964 | Groot | 297/218 X |
| 3,245,092 | 4/1966 | Kreuz | 5/433 X |
| 3,404,915 | 10/1968 | Filho | 297/17 X |
| 3,625,434 | 12/1971 | Kitovor | 297/185 X |
| 4,084,849 | 4/1978 | Ishida et al. | 297/377 X |

FOREIGN PATENT DOCUMENTS

| | | | |
|---|---|---|---|
| 1171778 | 1/1959 | France | 297/184 |

*Primary Examiner*—Jose V. Chen

*Attorney, Agent, or Firm*—Dickstein, Shapiro & Morin

[57] ABSTRACT

A beach lounge which may be folded up to form a carrying case with two separate compartments and a handle. The lounge includes two pairs of identically formed shell members pivotally connected in series to one another. The shell members are vented and have notches for gripping a towel cover to the lounge. A shade/support assembly may be adjusted to support the upper two shells in various positions to provide a frame for draping a towel to provide shade and to provide a handle when the lounge is folded into the carrying case position.

20 Claims, 9 Drawing Sheets

FOLDING BEACH LOUNGE

BACKGROUND OF THE INVENTION

The present invention relates generally to collapsible furniture and more particularly to a folding beach lounge which, when folded, forms compartments for carrying materials and when unfolded can assume a variety of positions.

The leisure activity of sun bathing at the beach, lake or other locale often involves a problem of logistics. First, a number of items such as sun tan lotion, sun glasses, towels, radios, food and beverages are desired at this site. Also, the site generally is some distance away from the means of transportation. Further, the sun bather may wish to avoid direct contact with the ground surface such as sand, rocks, pebbles or grass. Also, it is desirable to assume a variety of positions over time to limit the amount of sun exposure any part of the body is given. Further, one may wish to change positions to avoid fatigue from prolonged maintenance of a given posture. Lastly, it is desirable to block or shade the amount of sunshine being directed at the head while the remainder of the body is exposed, because the head often is more sensitive to sun light or receives more sun light in day-to-day activities.

In order to obtain these various objectives, a variety of devices are required, generally. For example, to transport the goods a tote bag is required. In order to ensure shade an umbrella is required and in order to obtain the variety of positions desired a versatile lounge is required. The use of all of these various devices often creates inconvenience in transportation.

Also, it is desirable to have at least two separate compartments for carrying articles, enabling the sun bather to segregate goods into two groups which do not comingle. For example, it is desirable to keep edible goods separate from lotions or electronic equipment separate from wet things.

Folding lounges and chairs which convert from a lounge or chair to a carrying case or suitcase are known. For example, British Patent No. 735,539 describes a folding chair. However, the chair does not provide separate compartments and does not provide a means for shading the user. In addition, the chair does not provide support for the variety of postures described above. Another combination seat and carrying bag is described in U.S. Pat. No. 2,915,154. However, this chair also does not provide separate compartments and does not provide support for a variety of postures described above.

Another convertible beach lounge-suit case combination is described in U.S. Pat. No. 3,179,465. The lounge converts into a suitcase which has one compartment and the back-rest of the lounge can be pivoted to a variety of angles. However, the lounge does not provide a variety of angles for support of the legs and does not provide two compartments and does not provide a shading means for the user. In U.S. Pat. No. 3,309,134, the lounge converts into a single compartment suit case. However, no shading means or two compartment case is provided. In addition, no means to vary the angle of support of the legs is described.

In U.S. Pat. No. 3,342,294, a back-rest is connected to a flexible, cloth-like mat which may be spread out for use during sun bathing and folded to form a compartment which fits within the back-rest to carry items. This device does not provide shading and does not provide support for the legs. Further, only a single compartment is described. U.S. Pat. No. 3,422,938 discloses a two shell support which pivots with respect to one another to form a carrying case. In this device no shading means is disclosed and no variable support for the legs is described. In addition, only a single compartment is provided.

In U.S. Pat. No. 3,532,378, a suit case is opened to provide a seat. A back-rest and a support for the lower legs is provided. However, no shading means is provided and the support for the lower legs cannot be adjusted. In U.S. Pat. No. 3,947,903, the back and leg supports of a lounge are pivoted into a seat support thereby forming one compartment. Only a single compartment is described and means to support the variety of postures described above is not provided. In addition, no shading means is described.

Another convertible lounge lounge/tote bag is described in U.S. Pat. No. 4,687,248. Here the back and leg supports pivot against the seat support and clasp at their ends. Flaps on the side of the seat support fold upward to create an accordion-like carry case. Variable support means supports a variety of postures. No shading means or separate compartments are provided.

There is a need in the art for a folding lounge which provides a variety of angles of support separately for the head, back, upper legs and lower legs, which folds into two separate compartments and which provides a means to shade the head of the user in some positions.

SUMMARY OF THE INVENTION

The disadvantages of the prior art are alleviated to a great extent by the present invention which provides a folding lounge having four shell portions pivotally connected to one another so that the two outermost shell parts pivot into the two innermost shell parts thus forming two compartments. Further, the two compartments pivot against one another to form a single structure for transport. Connecting means in the form of straps connect the compartments together so that they do not unfold in transport. A series of struts are pivotally connected to the shells and perform three functions: (1) providing a handle for the carrying case; (2) providing a structure for supporting the head and back shells of the lounge; and (3) providing a structure positioned above the head of the user over which a towel or similar item can be draped to provide shade. In use, the four shells are pivotally connected to one another in series and provide support to the head, torso, upper leg and lower leg of the user. Gripping means in the form of material notches, are provided to secure the towel to the shade structure. Straps are provided to perform a variety of functions including: (1) supporting the shading structure; (2) providing an arm rest when the lower and upper leg shells are positioned appropriately and (3) securing the two compartments one against the other so as to avoid their becoming unhinged in transport.

In one aspect of the invention the case is particularly useful for carrying items in two separate compartments where one does not want to have the items co-mingle. For example, electronic equipment may be separate from liquid goods. In addition, edible goods may be kept separate from lotions and the like. In another aspect of the invention, the lounge once unfolded is particularly useful for supporting a variety of positions. Because the angle of the four shells can be determined and set individually the lounge can assume support for a variety of postures. For example, the torso and head can be supported while the legs lie flat. Conversely, the head and torso can lie flat while the legs are supported in a bent position. Further, the head alone can be supported in a bent position. In another aspect of the invention, a shading means to shade the head of the user and means to secure the towel to the shading structure is provided.

It is an object of the present invention to provide a beach lounge.

Another object of the present invention is to provide a beach lounge which folds into a carrying case.

Yet another object of the present invention is to provide a beach lounge which folds into a carrying case containing two separate compartments.

Yet another object of the present invention is to provide a beach lounge which is able to assume a variety of positions.

It is a further object of the invention to provide a beach lounge with a shading structure to enable the user to shade his head.

Other objects and advantages of the present invention will become readily apparent from the following description and drawings which illustrate the preferred embodiment of the present invention.

BRIEF DESCRIPTION OF THE DRAWINGS

FIG. is a perspective view of a preferred embodiment of the folding beach lounge constructed according to the present invention.

DETAILED DESCRIPTION OF A PREFERRED EMBODIMENT

Figure 1:
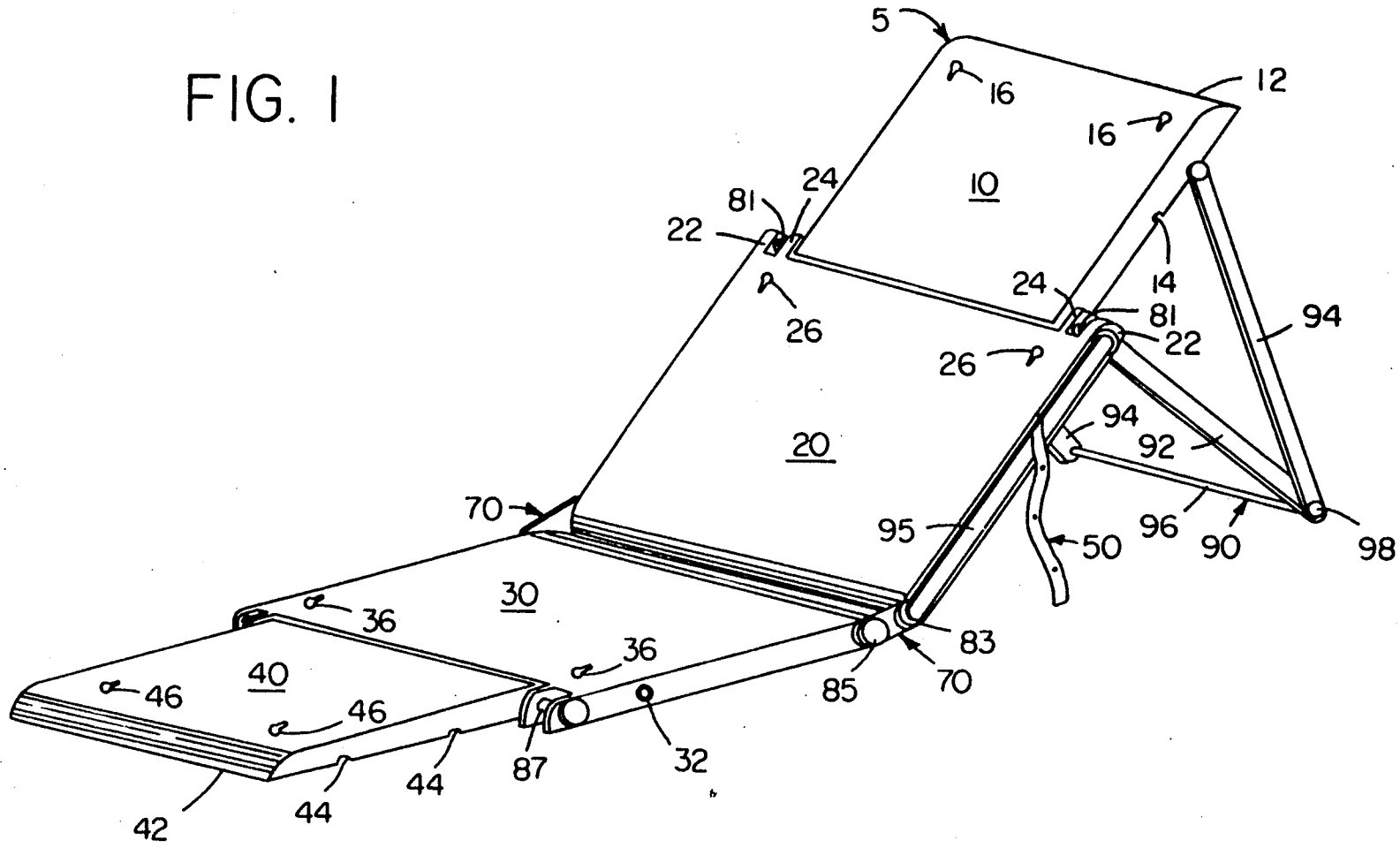
Figure 9:
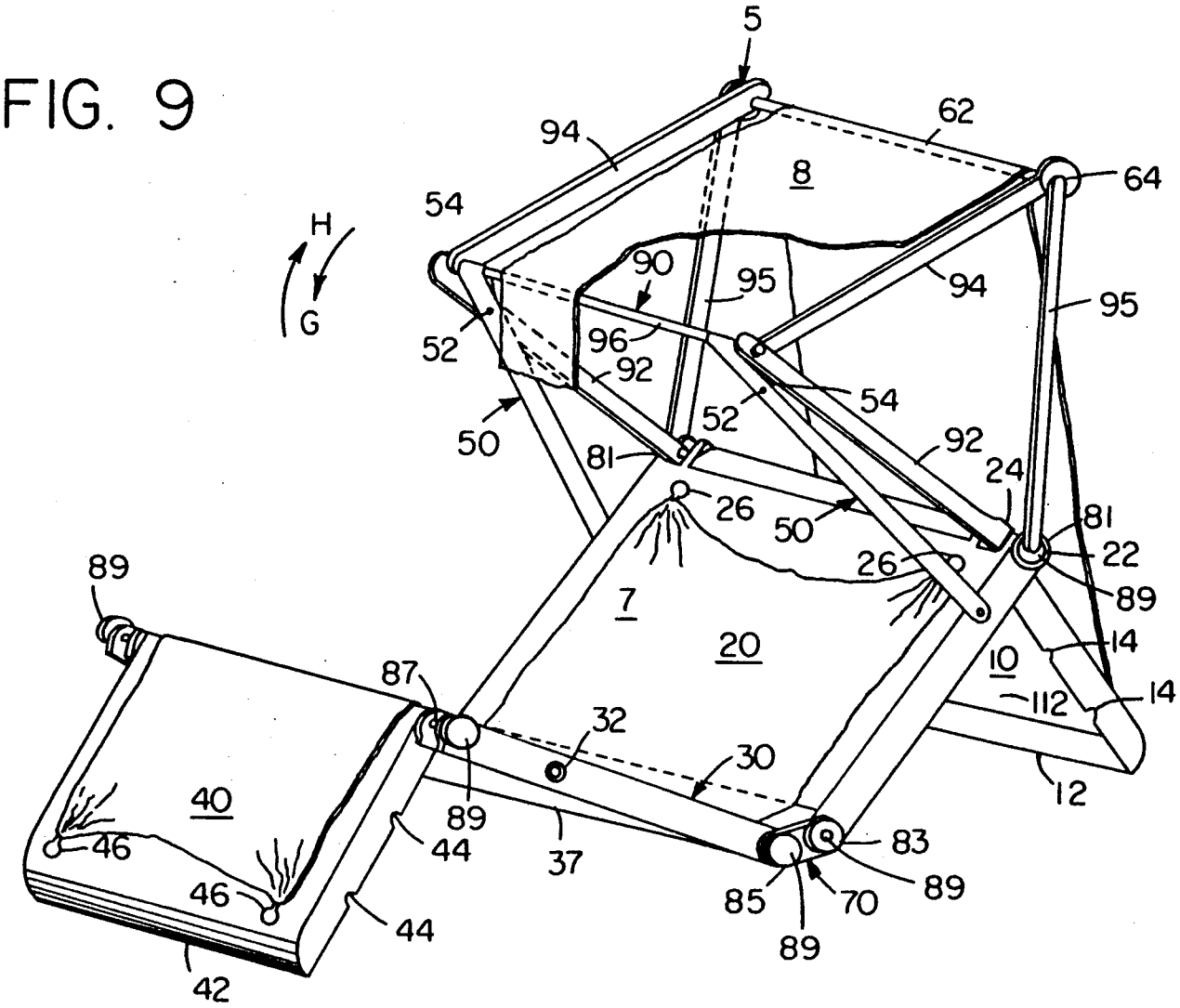
FIG. 9 is a perspective view of the folding beach lounge of FIG. 1 positioned to provide shade to the user.

Refer now to FIG. 1 wherein it is shown a preferred embodiment of a folding beach lounge, generally designated by reference numeral 5, according to the present invention. In FIG. 1 the lounge 5 is shown unfolded and positioned to support the head and torso of the user while the user's upper and lower legs lie flat with respect to the ground. The lounge includes a head shell 10, a torso shell 20, an upper leg shell 30 and a lower leg shell 40. The lounge 5 is constructed so that it may assume a variety of positions for supporting various portions of the user's body in various postures. Further, the lounge 5 is constructed so that it may be folded up into a compact carrying case which has two separate compartments. Further, the lounge has a shade/ support assembly 90 which is constructed so as to perform three separate functions. First, the assembly 90 may be adjusted to support the shells 10 and 20 as shown in FIG. 1. Secondly, the assembly 90 may be adjusted to provide a structure for shading the user (FIG. 9). Thirdly, the assembly 90 may be adjusted to provide a handle for the lounge 5 in its fully folded position (FIGS. 10–14).

The lounge 5 is constructed to support the posture of the user in a variety of positions. In FIG. 1 the lounge is positioned to support the user in a position where the torso and head are raised above the ground while his upper and lower legs lie flat with respect to the ground. The support for the head and torso of the user is provided by shells 10 and 20 of the lounge 5 respectively. The shells 10 and 20 are supported by the shade/ support assembly 90. Specifically, the first support legs 92 are pivoted with respect to the pivot shaft 81 and the second support legs 94 are pivoted with respect to the pivot rod 98 into engagement with one of the notches 14 on each of the shell 10. At this point, the user may lie down on the lounge 5 and his weight upon the shells 10 and 20 will be transmitted through legs 92 and 94 to the ground. Thus, the legs 92 and 94 are firmly positioned with respect to the ground due to friction between the legs 92 and 94 and the ground and/or the legs 92 and 94 burrowing or digging into the surface (i.e., sand) due to the weight of the sun bather. The legs 92 and 94 therefore will not slide. Thus, the user is supported in a sitting position by the construction of the lounge 5. The user may adjust the support for his head provided by the shell 10 by pivoting the shell 10 along pivot shaft 81 and moving the handle/support assembly to engage another notch 14. The shell 10 may have a plurality of notches 14 on its side. In the preferred embodiment there are two notches 14.

The shells 30 and 40 in FIG. 1 are supported by the surface and lay upon the ground. The sunbather may shape the surface to define a contour for the shells 30 and 40. For example, the sun bather may dig into the sand surface to provide a hole so that the shells 30 and 40 contour downward. Alternatively, the sunbather may make a mound out of the sand so as to support 30 and 40 at an angle thereby allowing the sunbather to raise his knees. However, the lounge 5 may be adjusted to support the legs in a position where the knees are raised with respect to the ground without forming a mound. As shown in FIG. 9 the shell 30 may be pivoted upwards away from the ground with respect to the hinge plate 70 at the pivot shaft 85. The shell 40 is constructed so that it may be pivoted with respect to the shell 30 along the pivot shaft 87 so that the outer edge 42 of the shell 40 contacts the ground. The outer edge 42 of the shell 40 is contoured so that it will burrow and dig into the ground when put into contact with the ground. Thus, the shells 30 and 40 may be positioned at an angle with respect to the ground and the weight of the user will be transmitted along the shell 40 and eventually to the ground through the edge 42. Thus, the shells 30 and 40 will support the lower and upper legs of the user should the user wish to assume a position where his knees are raised and his legs do not lie flat without forming a mound.

Figure 2:
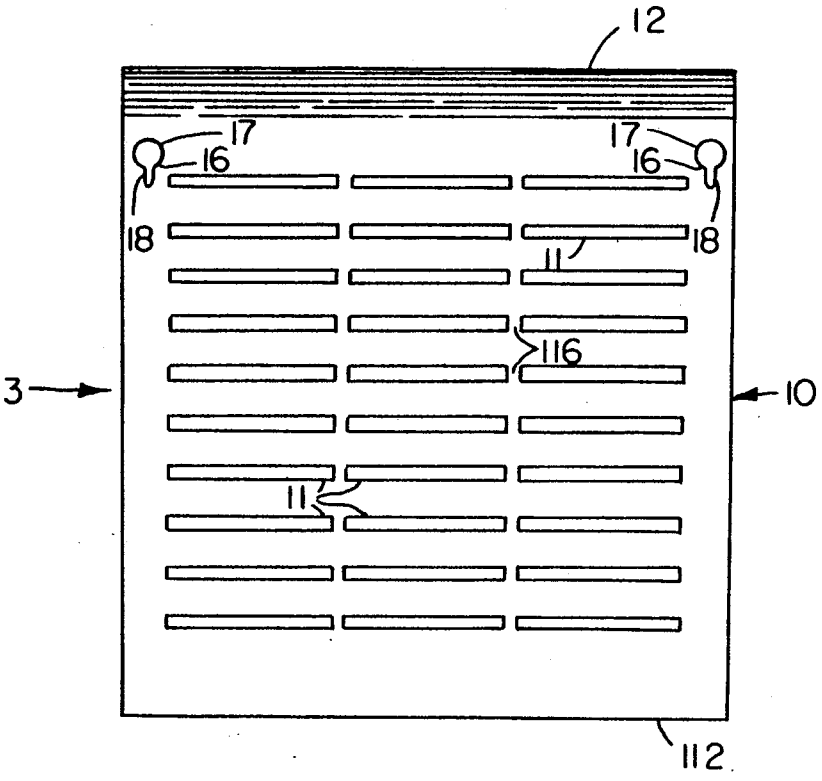
FIG. 2 is a plan view of the head shell of the folding beach lounge of FIG. 1.

FIG. 2 shows the upper surface of the head shell 10. In the preferred embodiment the shell is made by injection molding plastic. The shell 10 is also shaped and constructed exactly as the shell 40 so the same tool may be used to make both components. The outer surface 114 of the shell 10 has vents 11. Similarly, the outer surface 124 of the shell 20, the outer surface 134 of the shell 30 and the outer surface 144 of the shell 40 (see FIG. 6) also have vents which are numbered 21, 31, and 41 respectively. The vents 11, 21, 31 and 41 perforate the shells and extend through to the inner sides of the shells 112 of the shell 10, inner surface 122 of the shell 20, inner surface of 132 of the shell 30 and inner surface 142 of the shell 40, respectively. Accordingly, each of the vents extend through the thickness of the various shells. The structural integrity of the shells is enhanced through the use of supporting ribs which extend across the vents and perpendicular to the vents. Specifically, the shell 10 has supporting ribs 116, the shell 20 has supporting ribs 126, the shell 30 has supporting ribs 136 and the shell 40 has supporting ribs 146 (see FIG. 6). (Vents 11, 21, 31 and 41 are not shown in FIGS. 1, 8, 9, 10, and 11 for purposes of clarity). The vents allow air to contact and cool the skin of the user of the lounge or to dry a damp towel that may be draped over the lounge. When the lounge is folded for carrying articles, the vents provide ventilation for damp towels and other articles that may be carried.

Figure 3:
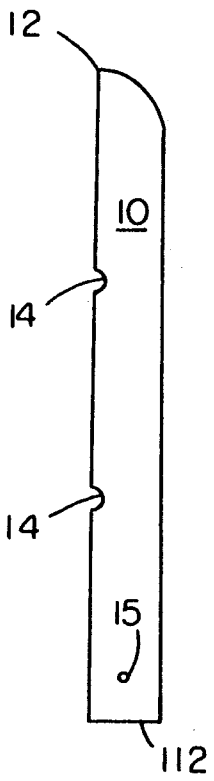
FIG. 3 is a side view of the head shell of FIG. 2 taken in the direction of line III of FIG. 2.

The shell 10 also has two material notches 16 which enable a cloth such as a towel to be extended through the circular portion 17 of the notch 16, and caught, upon the slot portion 18 of the notch 16, thereby forming a gripping means. The towel is secured to the shell 10 by poking a portion of the towel through the circular portion 17 of the notch 16. The towel portion is then forced into the slot portion 18 of the notch 16 thus compressing the towel portion and bringing the towel portion into firm engagement with the sides of slot portion 18. In this way the towel ,portion is firmly grasped by the sides of the slot portion 18 and the towel or other cloth or other covering 7 and 8 material is firmly secured to the lounge 5. To release, the steps for securing the towel or cloth are simply reversed. The other shells 20, 30 and 40 have similar notches. Specifically, the shell 20 has two notches 26 which include circular portions 127 and slot portions 128, the shell 30 has two notches 36 including circular portions 137 and slot portions 138 and the shell 40 has two notches 46 including circular portions 147 and slot portions 148. Thus, a towel or cloth can be secured to any of the shells 10, 20, 30 and/ or 40. In addition, a large towel or cloth could be secured to all four shells simultaneously and held by the eight notches. This would prevent the towel or cloth from falling or being blown away from the lounge 5. FIG. 3 shows the side of the shell 10 including the outer edge 12 and the notches 14. A pivot hole 15 is formed through the side of the shell 10 and through which extends the pivot shaft 81 (see FIG. 1). The shell 40 is the same construction as the shell 10 in the preferred embodiment, thus the shell 40 includes notches 44 (see FIG. 8).

Figure 4:
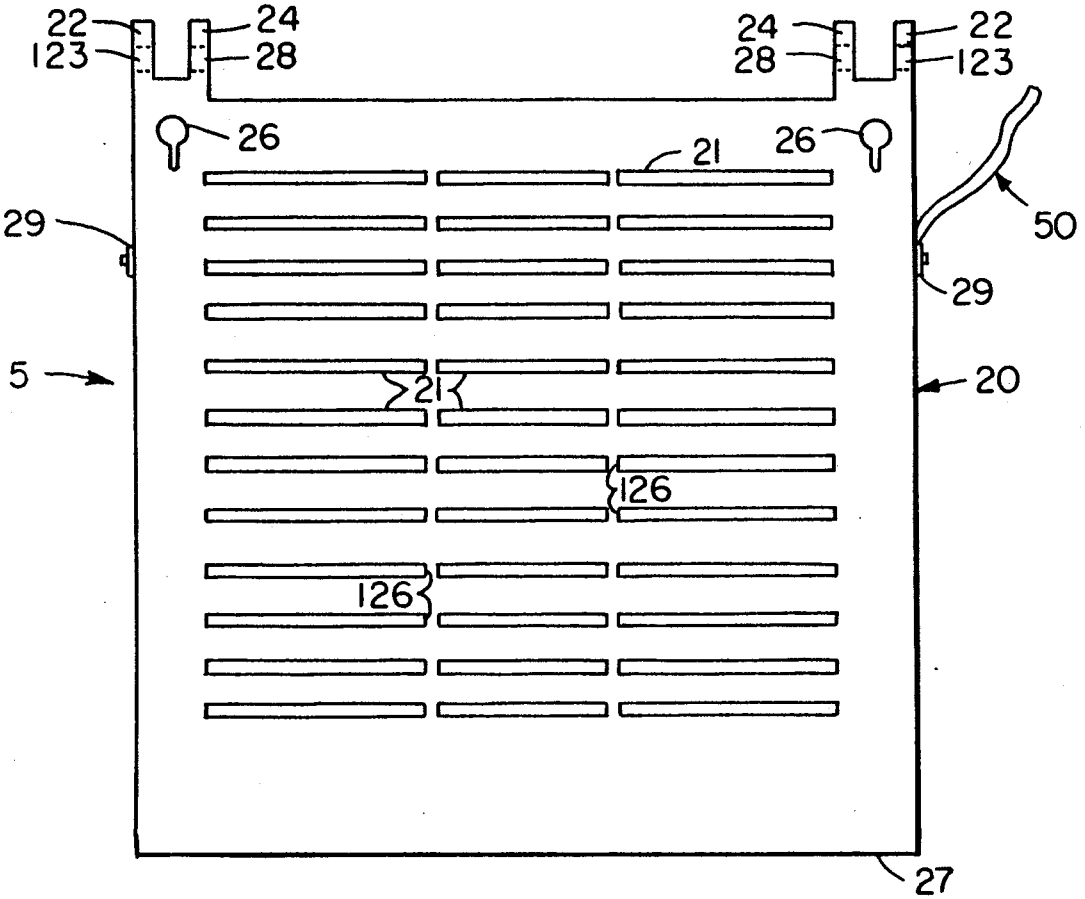
FIG 4 is a plan view of the torso shell of the folding beach lounge of FIG. 1.

FIG. 4 shows the torso shell 20 of the folding lounge 5. The torso shell 20 is constructed in exactly the same shape as the upper leg shell 30 and the same manufacturing tool may be used to make both shells 20 and 30. Further, the shell 20 is constructed with a first flange 22 and a second flange 24 on either side of the shell 20 which houses pivot holes 123 and 28, respectively. The flanges 22 and 24 and holes 123 and 28 receive the pivot shaft 81 which enables the shell 20 to be pivoted with respect to the shell 10. The shell 20 is constructed with a ground edge 27 which has an edge similar to the construction of the outer edge 12 of the shell 10. Thus, when the ground edge 27 contacts the surface such as sand, the weight of the user causes friction with the ground and/or forces the edge 27 into the ground and thereby the lounge 5 is firmly positioned with respect to the ground. A strap bolt 29 is attached to either side of the shell 20 to secure a strap 50 to the shell 20.

Figure 5:
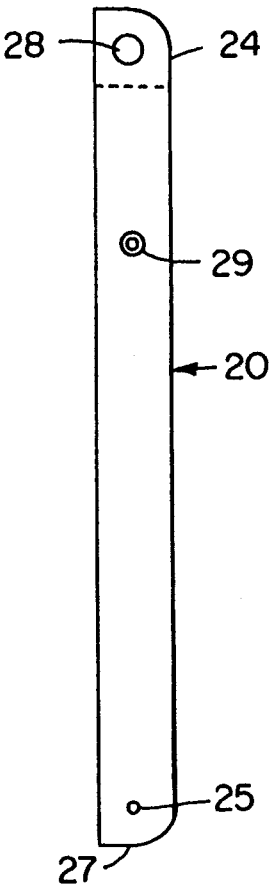
FIG. 5 is a side view of the torso shell of FIG. 4 taken in the direction of line V of FIG. 4.

FIG. 5 shows a side view of the shell 20 of FIG. 4. The pivot hole 25 is shown through which the pivot shaft 83 extends (see FIG. 1) thus enabling the shell 20 to pivot with respect to the hinge plate 70.

The shells 10, 20, 30 and 40 are shaped with a rectangular base with an inner surface and an outer surface and sides extending in one direction from the sides of the rectangular bases. The shells are also constructed and dimensioned such that they may be folded into one another to form two storage compartments. Specifically, the shell 10 may be pivoted along the pivot shaft 81 so that the inner surface 112 of shell 10 faces the inner surface 122 of shell 20. Thus, a first compartment 150 (see FIG. 10) is formed which may be suitable for carrying goods. Similarly, the shell 40 may be pivoted along the pivot shaft 87 into contact with the shell 30. Thus, forming a second and separate compartment 160 (see FIG. 10).

Figure 8:
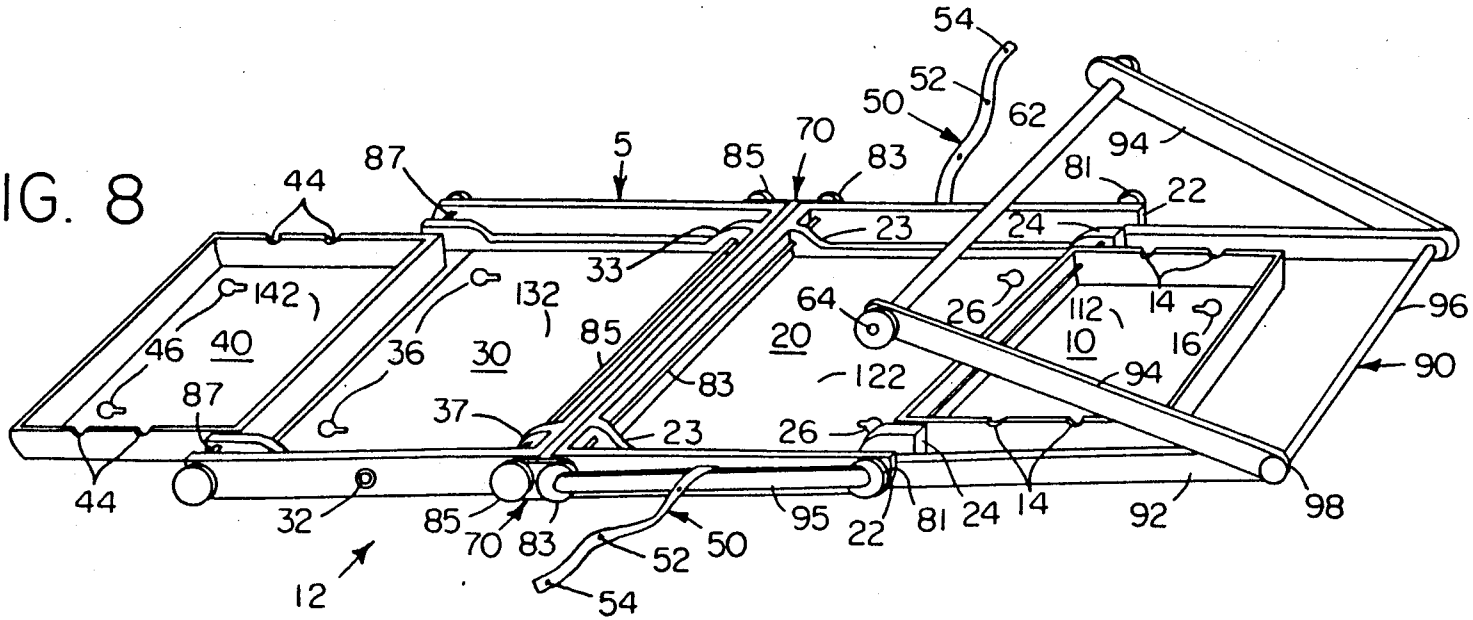
FIG. 8 is a perspective view of the inner side of the folding beach lounge of FIG. 1.

The pivot shaft 81 comprises a shaft which extends through holes 15 on either side of the shell 10 (see FIG. 8). These holes 15 extend throughout the width of both sides of the shell 10. The shaft then extends through holes 123 and 28 in the flanges 22 and 24 respectively on both sides of the shell 20. Positioned between the flanges 22 and 24 are the ends of the support leg 92. The ends of the support leg 92 have holes extending through their width and the shaft 81 is positioned within those holes. Thus, the support legs 92 are positioned between the flanges 22 and 24 and are pivotally secured to the shell 20. Finally, the shaft 81 extends past the flanges 22 and extends through holes in the third support leg 95 at which point the shaft 81 is capped by cap 89 to prevent axial movement. Thus, the support leg 95 is pivotally secured to the shell 20. In summary, the pivot shaft 81 enables the shell 10 to be pivoted with respect to the shell 20, the legs 92 to be pivoted with respect to the shell 20 and the legs 95 to be pivoted with respect to the leg 20.

The pivot shaft 83 extends through holes in the ridges 23 on both sides of the shell 20, and further extends through holes on both outer sides of the shell 20. (See FIG. 8) Finally, the shaft 83 extends through holes in the hinge plates 70 at which point the shaft 83 is capped by cap 89 to prevent axial movement. This enables the shell 20 to be pivoted with respect to the hinge plate 70. The shaft 85 is similarly constructed and enables the shell 30 to be pivoted with respect to the hinge plate 70. Thus, the pivot shafts 83 and 85 enable the shells 20 and 30 to be pivotally secured to the plate 70 and to be pivoted into substantial contact with each other.

Finally, the pivot shaft 87 consists of a shaft extending through holes on the sides of the shell 40 and through the two flanges on both sides of the shell 30. (See FIG. 8) At this point, the shaft 87 is capped by cap 89. Thus, the pivot shaft 87 enables the shell 40 to be pivoted with respect to the shell 30. As described earlier, shells 20 and 30 are constructed from the same tool, but because the lounge/support assembly 90 is only used at one end of the lounge 5 in the preferred embodiment, there are no support legs positioned between or outside the two flanges on either side of the shell 30.

Figure 6:
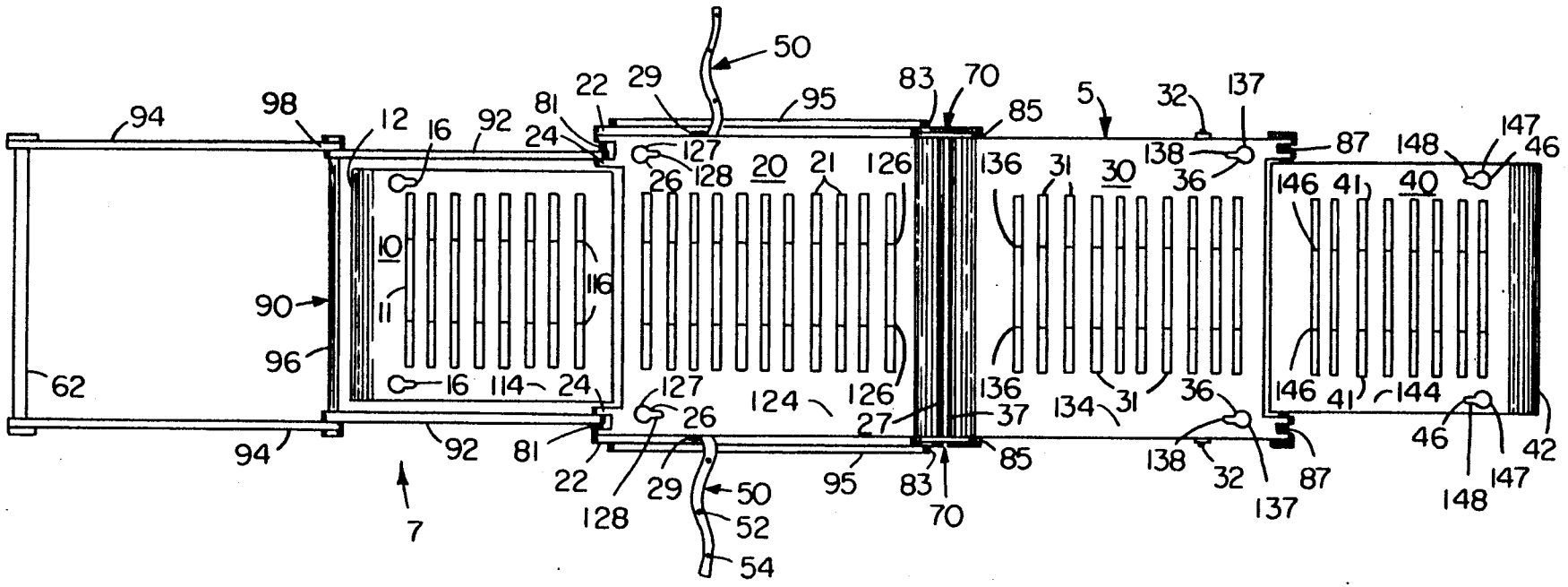
FIG. 6 a plan view of the folding beach lounge of FIG. 1 fully unfolded.

FIG. 6 shows a plan view of the lounge 5 fully unfolded so as to support the user lying completely flat. In the shade/support assembly 90, a handle 62 connects the second support legs 94 and the support strut 96 also connects the second support legs 94 forming a rectangle. The first support legs 92 are pivoted with respect to the second support legs 94 by the pivot rod 98. FIG. 6 also shows the outer surfaces of the shells including the outer surface 114 of the shell 10, the outer surface 124 of the shell 20, the outer surface 134 of the shell 30 and the outer surface 144 of the shell 40.

Figure 7:
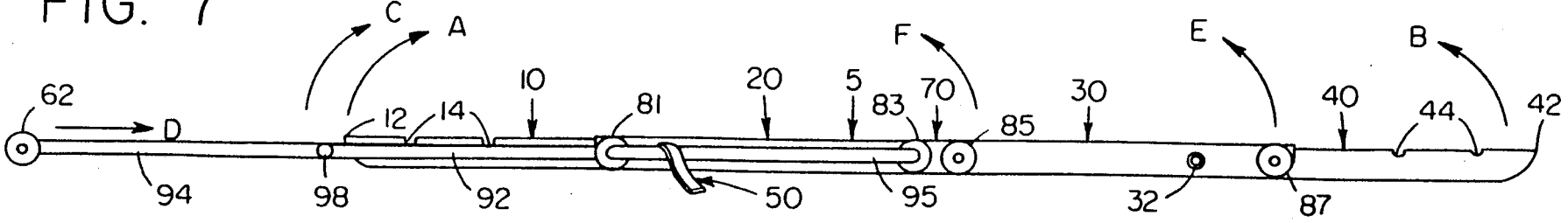
FIG. 7 is a side view of the folding beach lounge of FIG. 6 taken in the direction of line VII of FIG. 6.
Figure 12:
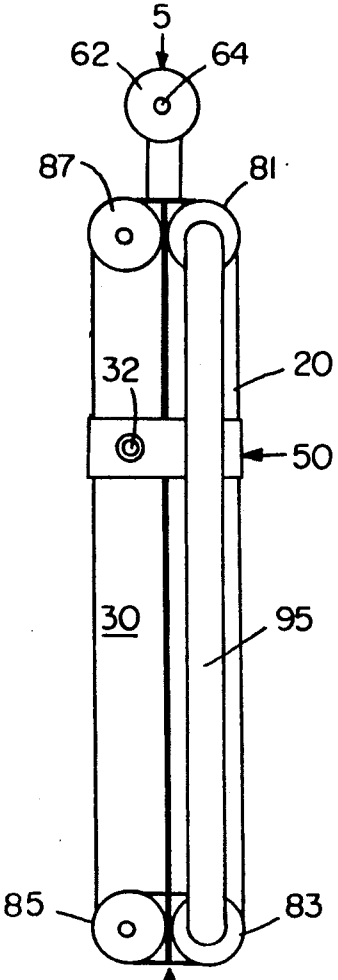
FIG. 12 is a side view of the folding beach lounge of FIG. 1 fully folded up.

FIG. 7 shows a side view of the folding lounge 5. FIG. 7 shows how the lounge 5 is constructed to fold up into a compact carrying case with the two compartments 150 and 160. First, the shell 10 is pivoted with respect to the pivot shaft 81 along arc of rotation A into the shell 20 to form the first compartment 150 (see FIG. 10). The shell 40 is similarly pivoted to the pivot shaft 87 along arc of rotation B into the shell 30 to form the second compartment 160 (see FIG. 10). Then the pivot rod 98 is rotated along arc of rotation C until it pivots 180° into the shell 20. When the pivot rod 98 is rotated along arc of rotation C, the handle 62 moves laterally along direction D such that when the pivot rod 98 is positioned within the shell 30 the handle 62 resides just above the pivot rod 81 and just outside the shell 20. The shell 30 is then pivoted along arc of rotation E with respect to the pivot rod 85 until it is perpendicular to hinge plate 70. Finally, the compartment 150 is rotated 90° with respect to the hinge 83 along arc of rotation F. At this point the compartments 150 and 160 abut one another with the handle 62 resides outside the compartments 150 and 160 thus forming the compact carrying case with handle. The straps 50 buckle against snaps located upon each other to hold the compartments 150 and 160 in firm contact (FIG. 12).

Refer now to FIG. 8 wherein is shown a perspective view of the inner side of the folding beach lounge 5 of FIG. 1. When the shell 10 is rotated into contact against the shell 20 a first compartment 150 is formed (see FIG. 10). When the shell 40 is rotated into contact against the shell 30 a second compartment 160 is formed (see FIG. 10). The compartments 150 and 160 are separated by the shells 20 and 40 and accordingly two separate groups of goods can be segregated, one into either of the compartments 150 and 160.

FIG. 9 shows the folding lounge 5 positioned to provide shade to the user through the use of the shade/support assembly 90. Third support legs 95 are pivoted with respect to pivot shaft 81 and connected by a peg into the peg hole 64 in the handle 62. In this position the first support legs 92, the second support legs 94 and the third support legs 95 form triangles above and on either side of the lounge 5. At the same time the handle 62, the two second support legs 94 and the support strut 96 form a rectangle over the lounge 5. The assembly 90 is prohibited from pivoting in the direction G because the first support leg 92 abuts the shell 20. Also the assembly 90 is prohibited from movement in the direction H by the straps 50 which are looped over the support strut 96 and secured to themselves by the use of the first snap 52 and the second snap 54. Thus the assembly 90 is firmly positioned with respect to the lounge 5 over the user. A towel or other cloth may be draped over the assembly 90 to provide shade to the user. The towel or other cloth may be secured to the shells 20 and 10 through use of the notches 26 and 16. In this way, the towel or other cloth can be secured to the lounge 5 and draped over the assembly 90 so as to preclude the towel or other cloth from being blown away or dropped.

FIG. 9 also shows how the edge 12 of the shell 10, the edge 42 of the shell 40 and the edge 37 of the shell 30 can be used to provide structural support so that the lounge 5 may be adapted by the used to assume a variety of configurations. The edges 12, 37 and 42 are forced against the ground surface by the weight of the user and thus the ground surface is used to create a structural force by friction and/or digging. By pivoting the shells 10, 20, 30 and 40 with respect to one another an infinite variety of configurations may be created. The shells 30 and 40 may lie flat against level ground or may be adjusted to uneven ground contours. Moreover, sand may be positioned for support under the shells 30 and 40 to adjust their angle as desired. Also the shells 10 and 20 may also lie flat against the ground and the assembly 90 positioned over the user's head for supporting a towel or other sunscreen. When used in this configuration, it is advantageous for the user to first lie on the lounge in a position as shown in FIG. 6 and then to pull the assembly 90 into an appropriate position such as shown in FIG. 9, by rotating the assembly 90 towards the head, or arrange the assemble 90 in another position, such as by digging the ends of the struts 94 into the sand, to support the sunscreen. Although the edge 27 of the shell 20 is not shown in FIG. 9 it is shaped the same as edge 37 and performs a similar function (see FIG. 6). Note also that the snaps 52 and 54 of the straps 50 may be snapped onto the snap 32 of the shell 30 to provide arm rests.

Figure 10:
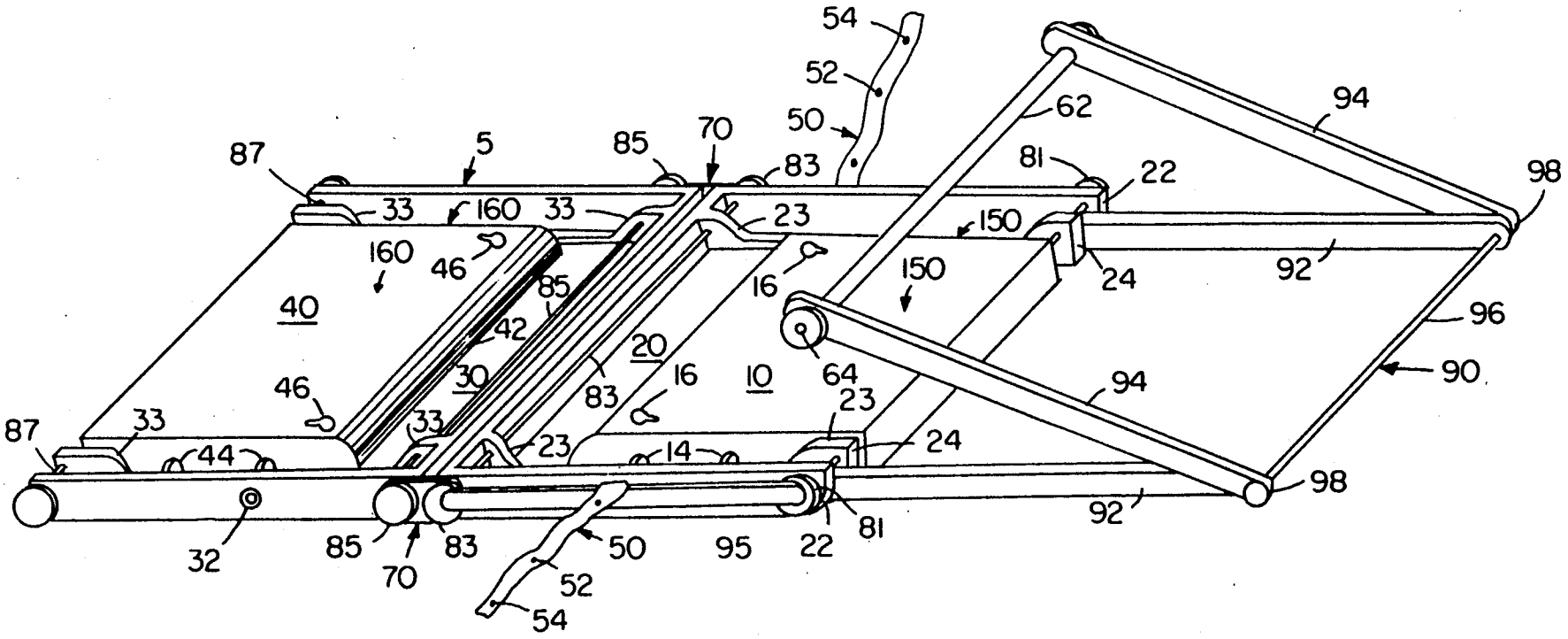
FIG. 10 is a perspective view of the folding beach lounge of FIG. 1 in a partially folded position.
Figure 11:
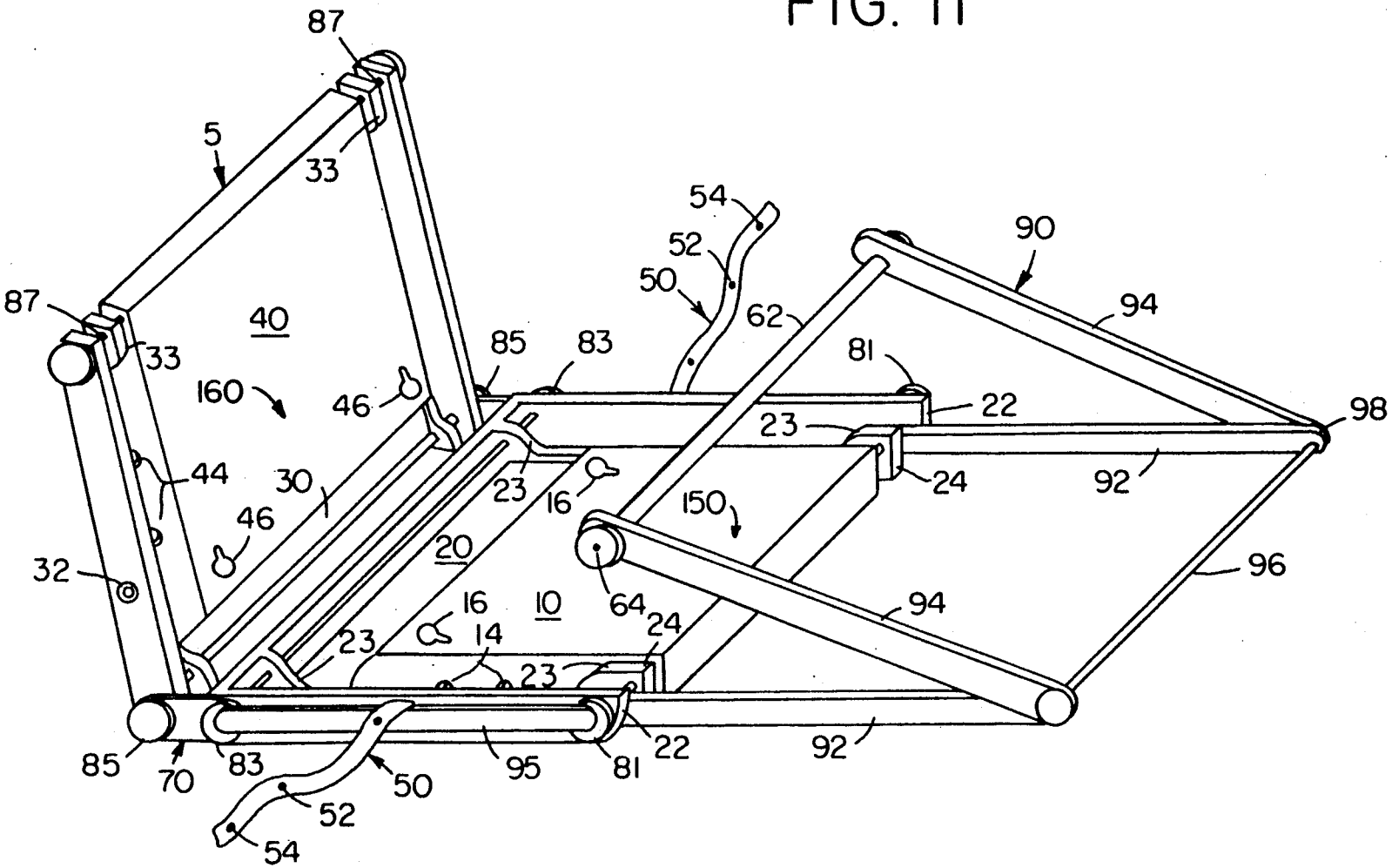
FIG. 11 is a perspective view of the folding beach lounge of FIG. 1 in partially folded position.

FIG. 10 shows the lounge 5 in its partially folded position. The shell 10 has been pivoted with respect to the pivot 81 into the shell 20 to create the first compartment 150. The shell 40 has been pivoted with respect to the pivot rod 87 into the shell 30 to create the second compartment 160. In order to position the handle 62 in its carrying case position, the first support legs 92 are pivoted with respect to the pivot rod 81 to straddle and reside between the shell 10 and the shell 20 on either side of the shell 10. The support strut 96 resides against the ridges 23. The second support legs 94 are pivoted with respect to the first support legs 92 so that they straddle and reside next to the support legs 92 between the shell 10 and the shell 20 on either side of the shell 10. The handle 62 would reside just outside the shell 10 so that the handle 62 may be readily gripped. FIG. 11 shows the lounge 5 in a partially folded position. The compartment 160 has been pivoted with respect to the pivot pin 85 and the hinge plates 70 so as to form one side of the carrying case. To continue the folding procedure the shade/support assembly 90 is pivoted into the shell 20 as described above and the compartment 150 is pivoted with respect to the hinge plates 70 so that it substantially contacts the compartment 160 to form a carrying case.

FIG. 12 is a side view of the folding beach lounge 5 fully folded up into its carrying case position. The straps 50 have snaps 52 and 54 which are positioned to snap into engagement with each other or with snaps positioned on the lounge 5 so that the straps 50 are taunt and snugly support the compartment 150 against the compartment 160 to assure that the carrying case 5 does not become unfolded (see FIG. 12).

Figure 13:
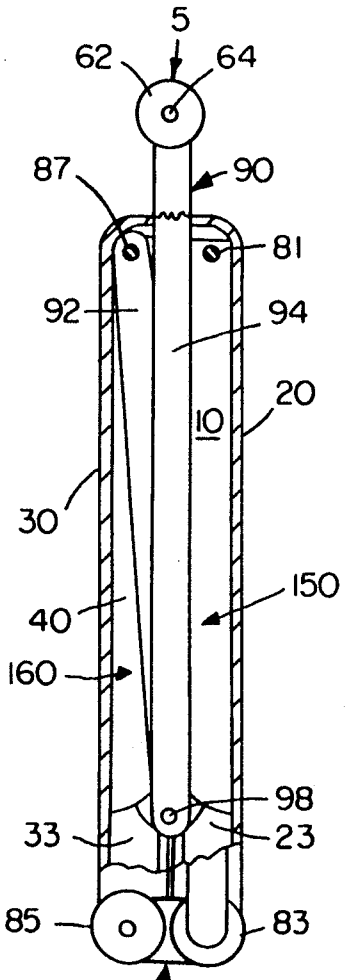
FIG. 13 is a partial cross-sectional view of the folding beach lounge of FIG. 12.

FIG. 13 is a partial cross-sectional view of FIG. 12 of the folding beach lounge 5 fully folded up into its carrying case position. The shade/support assembly 90 including legs 92 and 94 is shown folded up and positioned outside the shells 10 and 40. The assembly 90 abuts ridges 23 and 33.

Figure 14:
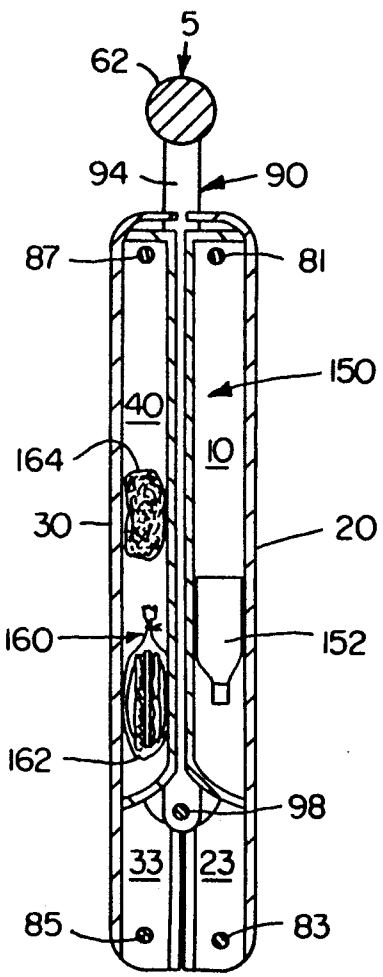
FIG. 14 is a cross-sectional view of the side of the folding beach lounge of FIG. 12.

FIG. 14 is a cross section of the folding beach lounge fully folded up into its carrying case position. The first compartment 150 is formed by the shell 10 and the shell 20 and the second compartment 160 is formed by the shell 30 and the shell 40. The two compartments 150 and 160 segregate goods stored in them which are shown in FIG. 14 as edible goods (a sandwich 162 and an apple 164) from the sun lotion 152.

The above description and drawings are only illustrative of preferred embodiments which achieve the objects, features and advantages of the present invention, and it is not intended that the present invention be limited thereto. Any modifications of the present invention which comes within the spirit and scope of the following claims is considered part of the present invention.

What is new and desired to be protected by Letters Patent of the United States is:

1. A folding lounge comprising a plurality of shell members, each of said shell members having a base having two ends, an outer and an inner surface to support a user and having sides extending opposite from said outer surfaces with respect to said user, said shell members being pivotally connected at at least one end to at least one other shell member for pivoting through greater than one hundred and eighty degrees of rotation with respect to such other member such that the pivotally connected shell members may be adjusted to a variety of positions for use as a lounge and may be adjusted to fold so that at least one shell member is positioned substantially entirely into another with two inner surfaces facing each other to form a carrying case with a plurality of storage compartments with at least one said storage compartment including a void at least as tall as one of said sides.

2. A folding lounge as in claim 1 further comprising:
a support frame means for supporting the lounge in a variety of positions; and
a handle means for carrying the lounge when folded in position.

3. A folding lounge as in claim 2 wherein each said support surface of each said shell member is rectangular in shape.

4. A folding lounge as in claim 3 further comprising four of said shell members, including two innermost and two outermost shell members, pivotally connected in series to one another so that the two outermost shell members are positioned within the two innermost shell members when the four shell members are folded into one another.

5. A folding lounge as in claim 4 wherein said shell members have vent means for cooling and drying said user of the lounge, said vent means extending through the thickness of the support surface of each shell member.

6. A folding lounge as in claim 5 wherein said shell members have one or more gripping means for releasably connecting a covering to the lounge, said gripping means positioned thereon to receive and hold secure the covering when draped over the unfolded lounge.

7. A folding lounge as in claim 2 further comprising:
said shell members each having an inner surface, sides and an outer surface;
said shell members including first, second, third and fourth shell members;
said first and fourth shell members being of substantially the same size and shape and comprising a first pair of shells;
said second and third shell members being of substantially the same size and shape comprising a second pair of shell members;
said first and second shell members being pivotally connected so that said first and second shell members may be pivoted against one another thereby substantially contacting one another and forming a first compartment;
said third and fourth shell members being pivotally connected so that the third and fourth shell members may be pivoted against one another thereby substantially contacting one another and forming a second compartment;
said first and second compartments being pivotally connected so that the first and second compartments may be pivoted against one another to form a carrying case;
a series of parallel vents extending through the entire thickness of each shell member;
a covering capable of being connected to the lounge;
one or more gripping means for releasably connecting a covering to the lounge, said gripping means extending through the entire thickness of each shell member to receive and hold secure the covering;
said gripping means including a notch extending through a surface of the lounge;
said notch having a circular portion and slot portion;
said circular portion being of a size sufficient to receive a portion of the material; and
said slotted portion being of a size and shape sufficient to releasably grip the portion of the covering inserted through the circular portion of said notch.

8. A folding lounge as in claim 7 wherein:
The first pair of shell members being approximately the same size and shape, and the second pair of shell members being approximately the same size and shape;
said first pair of shell members being of a different size and shape than said second pair of shell members;
said lounge being constructed such that when said lounge is completely unfolded, the four shell members are in direct contact with, and supported by, the ground,
the first pair of shell members providing support to the head and lower legs of the user respectively; and
said second pair of shell members providing support to the torso and upper legs of the user respectively.

9. A folding lounge as in claim 7 further comprising:
a first connector means for pivotally connecting said first shell member to said second shell member;
a second connector means for pivotally connecting said third shell member to said fourth shell member; and
a third connector means for pivotally connecting said third shell member to said fourth shell member.

10. A folding lounge as in claim 9 wherein:
the first connector means includes a first shaft which extends across the entire surface width of each of the first and second shell members through holes that extend through the thickness of the sides of the first and second shell members, said first shaft also extending through holes contained in flanges located on each side of the second shell members, thus creating a hinge-type joint; and a joint securing means for preventing axial movement of said first shaft in said first connector means.

11. A folding lounge as in claim 10 wherein said joint securing means includes caps attached to those portions of said shaft extending beyond the flanges.

12. A folding lounge as in claim 11 wherein said second connector means includes a second shaft that extends across the entire surface width of the second shell member; and a third shaft that extends across the entire surface width of the third shell member, both said second and third shafts protruding through holes extending through the thickness of the sides of the second and third shell members respectively, each of said shafts also extending through holes in hinge plates located along the outside surface of either side on both of the second and third shell members thereby rotatably joining the second shell member to the third shell member;

a joint securing means for preventing axial movement of the shafts in said connector means;

said joint securing means including caps attached to both ends of the second and third shafts; and wherein said third connector means includes a fourth shaft which extends across the entire surface width of each of the third and fourth shell members through holes that extends through the thickness of the sides of the third and fourth shell members;

joint securing means for preventing actual movement of said fourth shaft in said third connector means, said joint securing means including caps attached to those portions of said shaft extending beyond the sides of the third and forth shell members.

13. An apparatus for securing a cloth to a lounge comprising:

a lounge defined by a piece of furniture;

a cloth capable of being releasably connected to the lounge;

gripping means for releasably connecting the cloth to the lounge, said gripping means positioned on the lounge to receive and secure the cloth to the lounge;

said gripping means including a notch extending through a surface of the lounge;

said notch having a circular portion and slot portion;

said circular portion being of a size sufficient to receive a portion of the cloth; and said slot portion being of a size and shape sufficient to compress the portion of the cloth inserted through the circular portion of said notch whereby the cloth is forced into the slot portion to bring the cloth into firm engagement with the slot portion.

14. A folding lounge, comprising:

a plurality of shell members pivotally connected to each other such that when the shells are unfolded from one another they form a lounge and when folded into one another they form a carrying case with a plurality of storage compartments;

a support frame means for supporting the lounge in a variety of positions;

a handle means for carrying the lounge when folded in position;

said shell members each having an inner surface, sides and an outer surface;

said shell members including first, second, third and fourth shell members;

said first and fourth shell members being of substantially the same size and shape and comprising a first pair of shells;

said second and third shell members being of substantially the same size and shape and comprising a second pair of shell members;

said first and second shell members being pivotally connected so that said first and second shell members may be pivoted against one another thereby substantially contacting one another and forming a first compartment;

said first and fourth shell members being pivotally connected so that the third and fourth shell members may be pivoted against one another thereby substantially contacting one another and forming a second compartment;

said first and second compartments being pivotally connected so that the first and second compartments may be pivoted against one another to form a carrying case;

a series of parallel vents extending through the entire thickness of each shell member;

a covering capable of being connected to the lounge;

one or more gripping means for releasably connecting a covering to the lounge, said gripping means extending through the entire thickness of each shell member to receive and hold secure the covering;

said gripping means including a notch extending through a surface of the lounge;

said notch having a circular portion and slot portion;

said circular portion being of a size sufficient to receive a portion of the material;

said slotted portion being of a size and shape sufficient to releasably grip the portion of the covering inserted through the circular portion of said notch;

a first connector means for pivotally connecting said first shell member to said second shell member;

a second connector means for pivotally connecting said third shell member to said fourth shell member;

a third connector means for pivotally connecting said third shell member to said fourth shell member;

the first connector means includes a first shaft which extends across the entire surface width of each of the first and second shell members through holes that extend through the thickness of the sides of the first and second shell members, said first shaft also extending through holes contained in flanges located on each side of the second shell members, thus creating a hinge-type joint;

a joint securing means for preventing axial movement of said first shaft in said first connector means;

said joint securing means includes caps attached to those portions of said shaft extending beyond the flanges;

said second connector means includes a second shaft that extends across the entire surface width of the second shell member; and a third shaft that extends across the entire surface width of the third shell member, both said second and third shafts protruding through holes extending through the thickness of the sides of the second and third shell members respectively, each of said shafts also extending through holes in hinge plates located along the outside surface of either side on both of the second and third shell members thereby rotatably joining the second shell member to the third shell member;

a joint securing means for preventing axial movement of the shafts in said connector means;

said joint securing means including caps attached to both ends of the second and third shafts;

wherein said third connector means includes a fourth shaft which extends across the entire surface width of each of the third and fourth shell members through holes that extends through the thickness of the sides of the third and fourth shell members; joint securing means for preventing axial movement of said fourth shaft in said third connector means, said joint securing means including caps attached to those portions of said shaft extending beyond the sides of the third and fourth shell members;

support frame adjusting means for adjusting the angular position of the first and second shell members;

said support frame adjusting means including a pair of rigid first support leg members located on either side of the first shell member, positioned so as to straddle the first shell member, each first support leg member having a first end and a second end and being pivotally connected at their first ends to the flanges of the second shell member, and a pivot rod having two ends being pivotally connected at either end to the second end of the first support leg members;

said support frame adjusting means also including a pair of rigid second support leg members located on either side of the first support leg members, positioned so as to straddle the first support leg members;

one end of the second support leg members being pivotally connected to said pivot rod; and the opposite end of the second support leg members being connected to a handle shaft.

15. A folding lounge as in claim 14 wherein:

said first support leg members are pivotally connected to said flanges located on the second shell member; and said second support leg members are pivotally connected to and straddle the first support leg members.

16. A folding lounge as in claim 15 wherein the first shell member has adjustment notches located on both outer sides for engaging the handle shaft.

17. A folding lounge as in claim 16 wherein said support frame adjusting means further comprises two third support leg members which may be connected to said support means to provide a shade frame means for producing shade for the occupant.

18. A folding lounge as in claim 17 wherein:

said third support leg members include rigid members located on both sides of the second shell member; and said third support leg members have first ends removably affixed the sides of the second shell members and the second ends of the third support leg members being pivotally connected to the second shell member, such that the third support leg members may rotate freely when their first ends are detached from the second shell members and may be connected to said handle shaft.

19. The folding lounge as in claim 18 further comprising strap members located on either side of the second shell member;

said strap members having firs ends removably affixed to a first strap securing means for releasably connecting the strap members to the lounge said first strap securing means being located on either side of the second shell member;

said strap members having second ends removably affixed to a second strap securing means for releasably connecting the strap member to the lounge said second strap securing means being located on either side of the third shell member such that the user may readily and easily detach said second ends from said third shell; and said strap members having a third strap securing means for removably affixing the second ends of the strap members to the middle portion of the strap said third strap securing means being located between the ends of the strap members such that the user may secure the shade frame to the lounge by looping the second end of the strap members over the pivot rod and releasably affixing the second end of the strap members to the third strap securing means.

20. A folding lounge as defined in claim 19 wherein the shade frame includes:

said first support leg members, second support leg members and third support leg members being pivoted and connected to form a triangle above and on either side of the first and second shell members;

said pivot rod, handle means and second support leg members being pivoted and connected to form a rectangle above the first and second shell members; and said strap members being releasably secured to said first support leg members to secure said shade means in a fixed position relative to the first and second shell members.

* * * * *